US011692691B1

(12) United States Patent
Lu et al.

(10) Patent No.: US 11,692,691 B1
(45) Date of Patent: Jul. 4, 2023

(54) FRAME STRUCTURE FOR CEILING LIGHTING DEVICE

(71) Applicant: Xiamen PVTECH Co., Ltd., Fujian (CN)

(72) Inventors: Fuxing Lu, Fujian (CN); Sishan Liao, Fujian (CN)

(73) Assignee: Xiamen PVIECH Co., Ltd., Fujian (CN)

( * ) Notice: Subject to any disclaimer, the term of this patent is extended or adjusted under 35 U.S.C. 154(b) by 0 days.

(21) Appl. No.: 18/080,754

(22) Filed: Dec. 14, 2022

(30) Foreign Application Priority Data

Sep. 30, 2022 (CN) ..... 202222620598.7

(51) Int. Cl.

| | |
|---|---|
| ***F21V 1/02*** | (2006.01) |
| ***F21V 21/04*** | (2006.01) |
| ***F21S 8/04*** | (2006.01) |
| ***F21V 1/04*** | (2006.01) |

(52) U.S. Cl.
CPC ..... *F21V 21/041* (2013.01); *F21S 8/04* (2013.01); *F21S 8/043* (2013.01); *F21V 1/02* (2013.01); *F21V 1/04* (2013.01)

(58) Field of Classification Search
CPC . F21V 1/02; F21V 1/04; F21V 21/041; F21V 21/049; F21V 2200/20; F21S 8/04; F21S 8/043; F21S 8/046
See application file for complete search history.

(56) References Cited

U.S. PATENT DOCUMENTS

2010/0265722 A1* 10/2010 Sohn ..... F21V 15/01 362/257

* cited by examiner

*Primary Examiner* — Sean P Gramling
(74) *Attorney, Agent, or Firm* — Winston Hsu

(57) ABSTRACT

A frame structure for ceiling lighting device is provided, which includes a plurality of first frame bars, a plurality of second frame bars and a plurality of corner braces. Each first frame bar includes a first frame bar body and a first chamber structure disposed on one side of the first frame bar body. Each second frame bar includes a second frame bar body and a second chamber structure disposed on one side of the second frame bar body. Each corner brace includes a first extension arm inserted into an opening at one end of the first chamber structure of one of the first frame bars and a second extension arm inserted into the opening at one end of the second chamber structure of one of the second frame bars, such that the first frame bars and the second frame bars can be combined with each other.

8 Claims, 14 Drawing Sheets

FRAME STRUCTURE FOR CEILING LIGHTING DEVICE

BACKGROUND OF THE INVENTION

1. Field of the Invention

The present invention relates to a frame structure, in particular to a frame structure for ceiling lighting device.

2. Description of the Prior Art

The frame structures of most of currently available ceiling lamps are made of metal, which are heavy in weight and of high cost. Besides, metal components are of high rigidity. Therefore, when several metal components are combined with each other via clearance fit or interference fit, they cannot be stably combined with each other. The above factors make these metal components difficult to be combined with each other. In addition, these metal components are prone to burrs during the manufacturing process, which significantly influences the assembly of these metal components or installing the metal frame formed by these metal components on a ceiling.

SUMMARY OF THE INVENTION

One embodiment of the present invention provides a frame structure for ceiling lighting device, which includes a plurality of first frame bars, a plurality of second frame bars and a plurality of corner braces. Each of the first frame bars includes a first frame bar body and a first chamber structure disposed on one side of the first frame bar body. Each of the second frame bars includes a second frame bar body and a second chamber structure disposed on one side of the second frame bar body. Each of the corner braces includes a first extension arm inserted into an opening at one end of the first chamber structure of one of the first frame bars and a second extension arm inserted into the opening at one end of the second chamber structure of one of the second frame bars, such that the first frame bars and the second frame bars can be combined with each other. The first frame bars, the second frame bars and the corner braces are made of plastics.

In one embodiment of the present invention, the first extension arm is combined with the first chamber structure in vertical direction via clearance fit. The first extension arm is combined with the first chamber structure in horizontal direction via interference fit.

In one embodiment of the present invention, each of the first frame bars further includes a first upper extension plate and a first lower extension plate respectively disposed at the top and the bottom of the first frame bar body of the first frame bar. The width of the first upper extension plate is greater than the width of the first lower extension plate.

In one embodiment of the present invention, each of the second frame bars further includes a second upper extension plate and a second lower extension plate respectively disposed at the top and the bottom of the second frame bar body of the second frame bar. The width of the second upper extension plate is less than the width of the second lower extension plate.

In one embodiment of the present invention, each of the corner braces further includes a L-shaped plate, an upper cover and a lower cover. The upper cover and the lower cover are respectively disposed at the top and the bottom of the L-shaped plate. The L-shaped plate includes a first portion and a second portion perpendicular to each other. The first extension arm and the second extension arm are respectively disposed at the first portion and the second portion.

In one embodiment of the present invention, each of the first portions includes a first protrusion block and any one of the two ends of the first frame bar body of each of the first frame bars is provided with a first break corner. The first protrusion block is corresponding to one of the first break corners.

In one embodiment of the present invention, each of the second portions includes a second protrusion block and any one of two ends of the second frame bar body of each of the second frame bars is provided with a second break corner. The second protrusion block is corresponding to one of the second break corners.

In one embodiment of the present invention, the first extension arm includes a first supporting arm having a first central hole and a first fixation portion having a first snap-fit hook. The first fixation portion is disposed in the first central hole and connected to the first supporting arm. Any one of the two ends of the first frame bar body of each of the first frame bars is provided with a first installation hole and the first snap-fit hook is corresponding one of the first installation holes.

In one embodiment of the present invention, there is a distance between a plane passing through the surface of the first portion and a plane passing through the surface of the first supporting arm, and the plane passing through the surface of the first portion passes through the surface of the first snap-fit hook of the first fixation portion.

In one embodiment of the present invention, the second extension arm includes a second supporting arm having a second central hole and a second fixation portion having a second snap-fit hook. The second fixation portion is disposed in the second central hole and connected to the second supporting arm. Any one of the two ends of the second frame bar body of each of the f second frame bars is provided with a second installation hole and the second snap-fit hook is corresponding one of the second installation holes. There is a distance between a plane passing through the surface of the second portion and a plane passing through the surface of the second supporting arm. The plane passing through the surface of the second portion passes through the surface of the second snap-fit hook of the second fixation portion.

The frame structure for ceiling lighting device in accordance with the embodiments of the present invention may have the following advantages:

(1) In one embodiment of the present invention, the frame structure for ceiling lighting device includes the first frame bars, second frame bars and corner braces. The above first frame bars and second frame bars cam be directly combined with each other via the corner braces in order to form the frame structure. Thus, the assembly process of the frame structure can be simple, which is more convenient in use.

(2) In one embodiment of the present invention, the frame structure for ceiling lighting device includes the first frame bars, second frame bars and corner braces. The first frame bars and second frame bars can be directly combined with each other via the corner braces by interference fit so as to form the frame structure. Therefore, the assembly process of the frame structure can be easily performed and can achieve high structural stability.

(3) In one embodiment of the present invention, each first frame bar of the frame structure for ceiling lighting device includes the first frame bar body, first upper extension plate and first lower extension plate. Besides, the width of the first upper extension plate is greater than the width of the first lower extension plate. Each second frame bar of the frame structure for ceiling lighting device includes the second frame bar body, second upper extension plate and second lower extension plate. Besides, the width of the second upper extension plate is greater than the width of the second lower extension plate. Via the above structure design, the first frame bars can be easily fixed on the ceiling and the second frame bars can provide supporting effect. In addition, the first frame bars and second frame bars are not interfered with each other. The above structure design can further enhance the structural stability of the frame structure.

(4) In one embodiment of the present invention, each corner brace of the frame structure for ceiling lighting device includes the L-shaped plate, first extension arm and second extension arm. The L-shaped plate has the first portion and second portion perpendicular to each other. The first extension arm and second extension arm are respectively disposed at the first portion and the second portion. The first extension arm includes the first supporting arm and first fixation portion having the first snap-fit hook. There is a distance between the plane passing through the surface of the first portion and the plane passing through the surface of the first supporting arm. The plane passing through the surface of the first portion passes through the surface of the first snap-fit hook of the first fixation portion. The second extension arm also has the same structure. The above structure design makes the outer surface of the frame structure be smooth, so the appearance of the frame structure can be beautiful so as to conform to actual requirements.

(5) In one embodiment of the present invention, all components of the frame structure for ceiling lighting device can be made of plastics duo to the structure design thereof. Accordingly, the weight of the frame structure can be greatly reduced and the cost thereof can be effectively decreased. Thus, the application of the frame structure can be more comprehensive in application.

(6) In one embodiment of the present invention, all components of the frame structure for ceiling lighting device can be made of plastics duo to the structure design thereof. Therefore, the color of the frame structure can be changed by adding plastic colorant during the manufacturing process thereof. Thus, the frame structure can be more flexible in use.

Further scope of applicability of the present application will become more apparent from the detailed description given hereinafter. However, it should be understood that the detailed description and specific examples, while indicating exemplary embodiments of the present invention, are given by way of illustration only, since various changes and modifications within the spirit and scope of the present invention will become apparent to those skilled in the art from this detailed description.

BRIEF DESCRIPTION OF THE DRAWINGS

The present invention will become more fully understood from the detailed description given herein below and the accompanying drawings which are given by way of illustration only, and thus are not limitative of the present invention and wherein.

DETAILED DESCRIPTION

Figure 1:
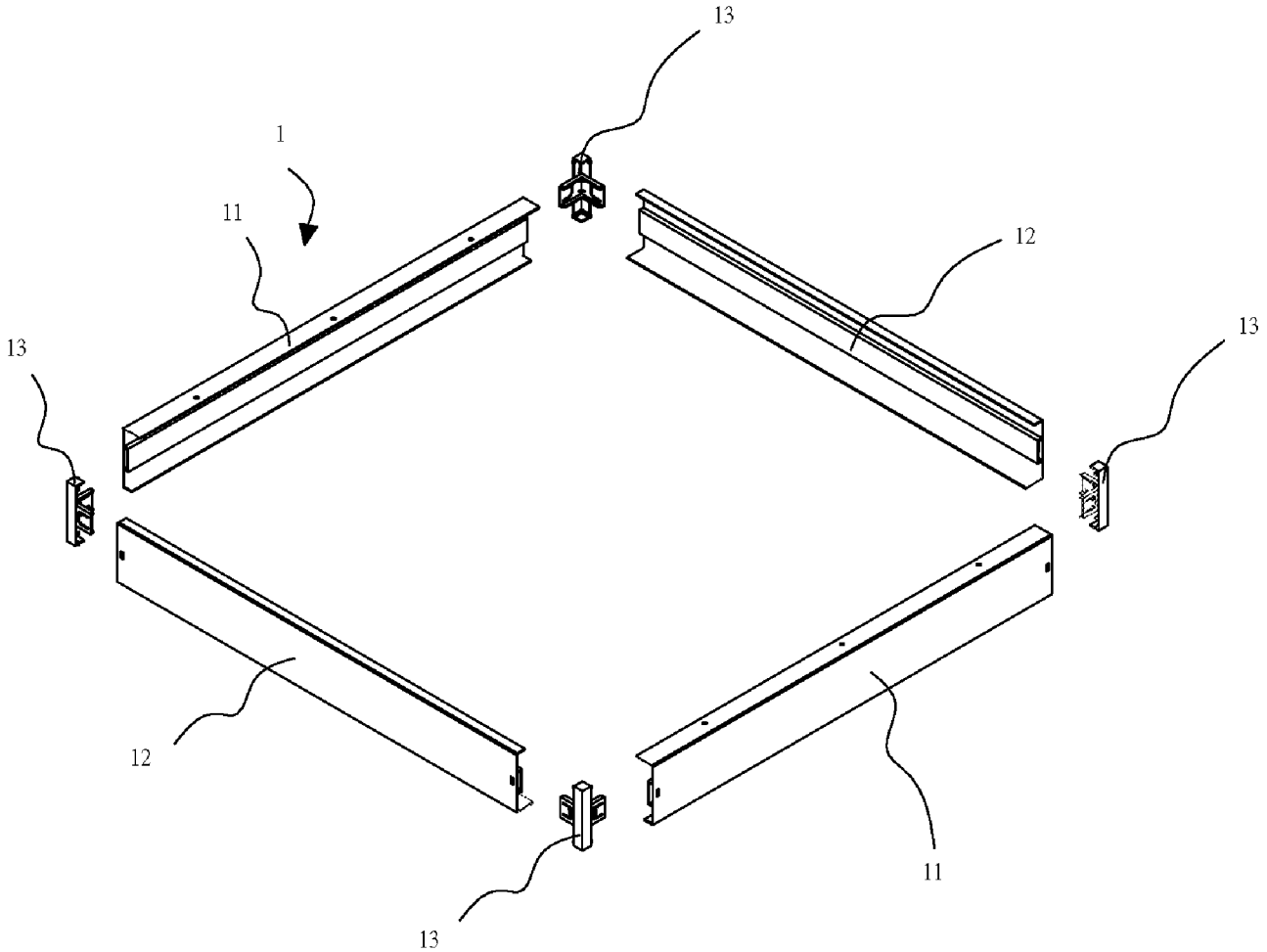
FIG. 1 is an exploded view of a frame structure for ceiling lighting device in accordance with one embodiment of the present invention.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing. It should be understood that, when it is described that an element is "coupled" or "connected" to another element, the element may be "directly coupled" or "directly connected" to the other element or "coupled" or "connected" to the other element through a third element. In contrast, it should be understood that, when it is described that an element is "directly coupled" or "directly connected" to another element, there are no intervening elements.

Please refer to FIG. 1, which is an exploded view of a frame structure for ceiling lighting device in accordance with one embodiment of the present invention. As shown in FIG. 1, the frame structure 1 for ceiling lighting device includes a plurality of first frame bars 11, a plurality of second frame bars 12 and a plurality of corner braces 13. The first frame bars 11 and second frame bars 12 are combined with each other via the corner braces 13 to form the frame structure 1.

Figure 2:
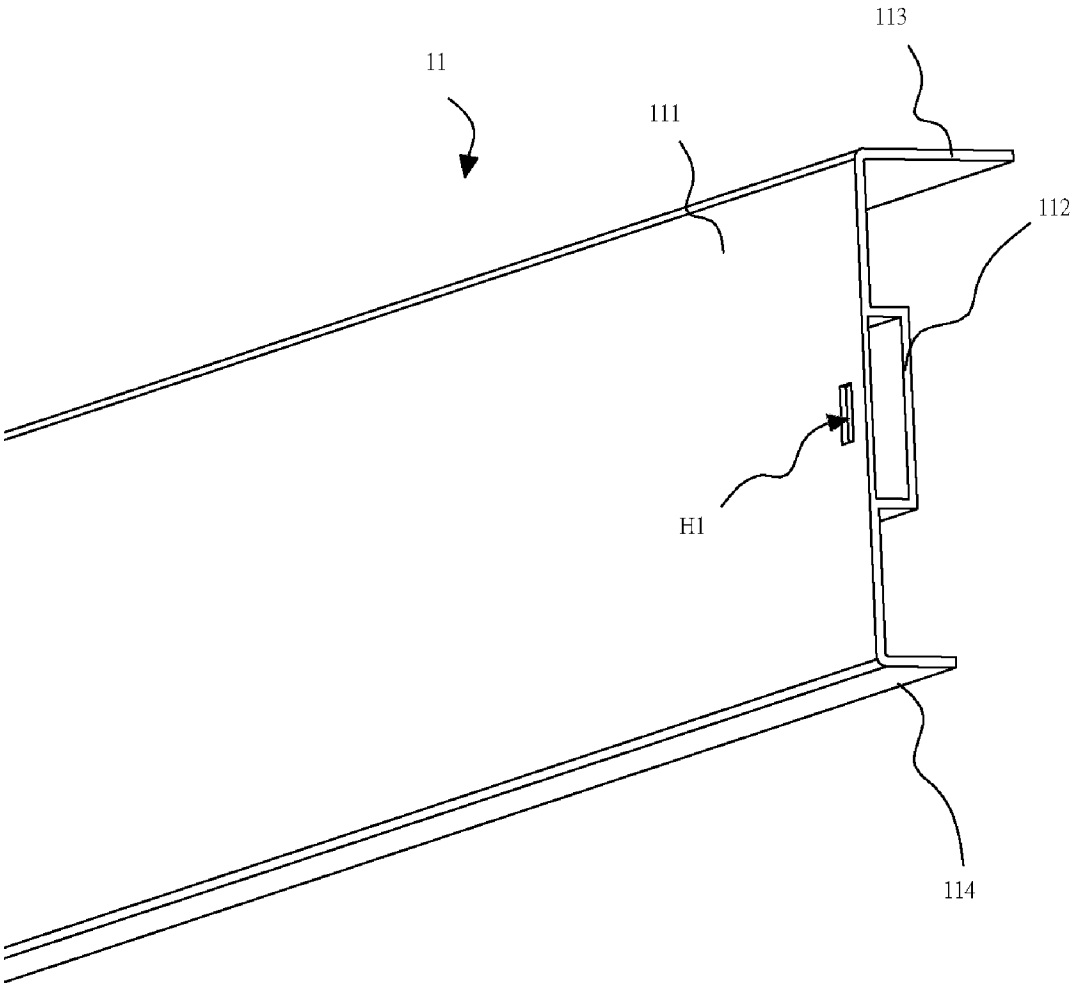
FIG. 2 is a first schematic view for illustrating a structure of a first frame bar of the frame structure for ceiling lighting device in accordance with one embodiment of the present invention.
Figure 3:
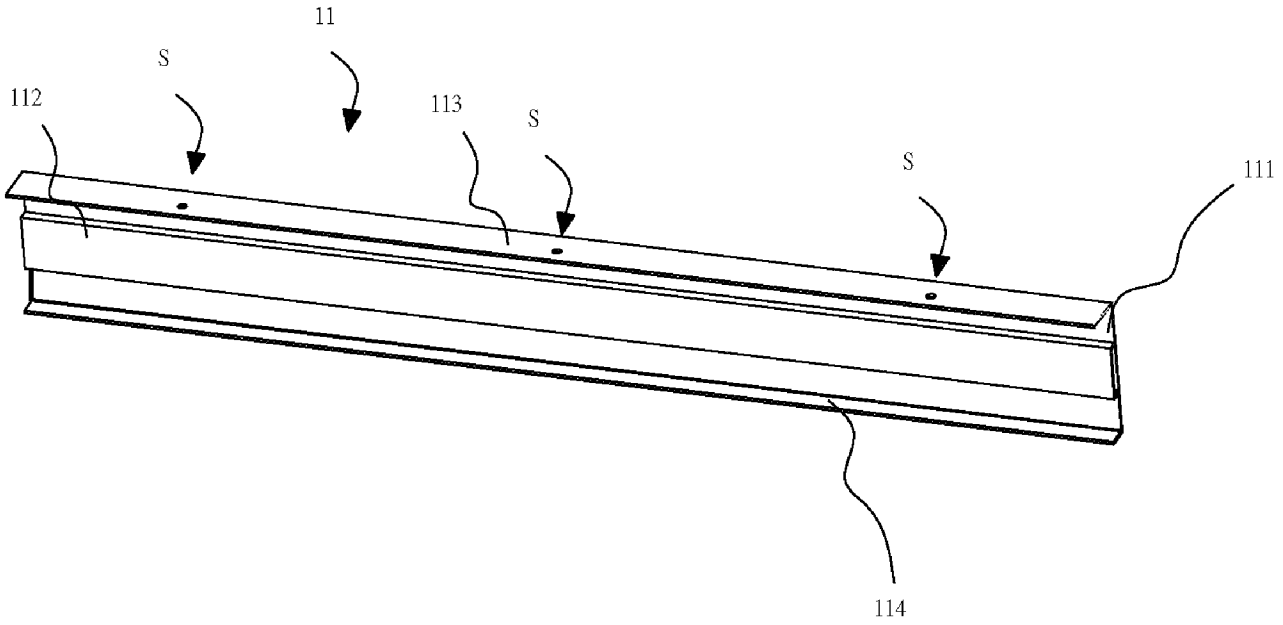
FIG. 3 is a second schematic view for illustrating the structure of the first frame bar of the frame structure for ceiling lighting device in accordance with one embodiment of the present invention.

Please refer to FIG. 2 and FIG. 3, which are a first schematic view and a second schematic view for illustrating a structure of a first frame bar of the frame structure for ceiling lighting device in accordance with one embodiment of the present invention respectively. As shown in FIG. 2 and FIG. 3, each first frame bar 11 includes a first frame bar body 111, a first chamber structure 112, a first upper extension plate 113 and a first lower extension plate 114.

The first chamber structure 112 is disposed at one side of the first frame bar body 111. A space is formed between the first chamber structure 112 and the first frame bar body 111. Any one of the two ends of the first chamber structure 112 has an opening. In the embodiment, the space may be rectangular. In another embodiment, the space may also be cylindrical or of other shapes, which can be changed according to actual requirements. The first upper extension plate 113 and first lower extension plate 114 are disposed at the top and bottom of the first frame bar body 111 respectively. Besides, the width of the first upper extension plate 113 is greater than that of the first lower extension plate 114. Any one of the two ends of the first frame bar body 111 is provided with a first installation hole H1 connected to the first chamber structure 112. In addition, the first upper extension plate 113 is further provided with a plurality of tapped holes S.

Figure 4:
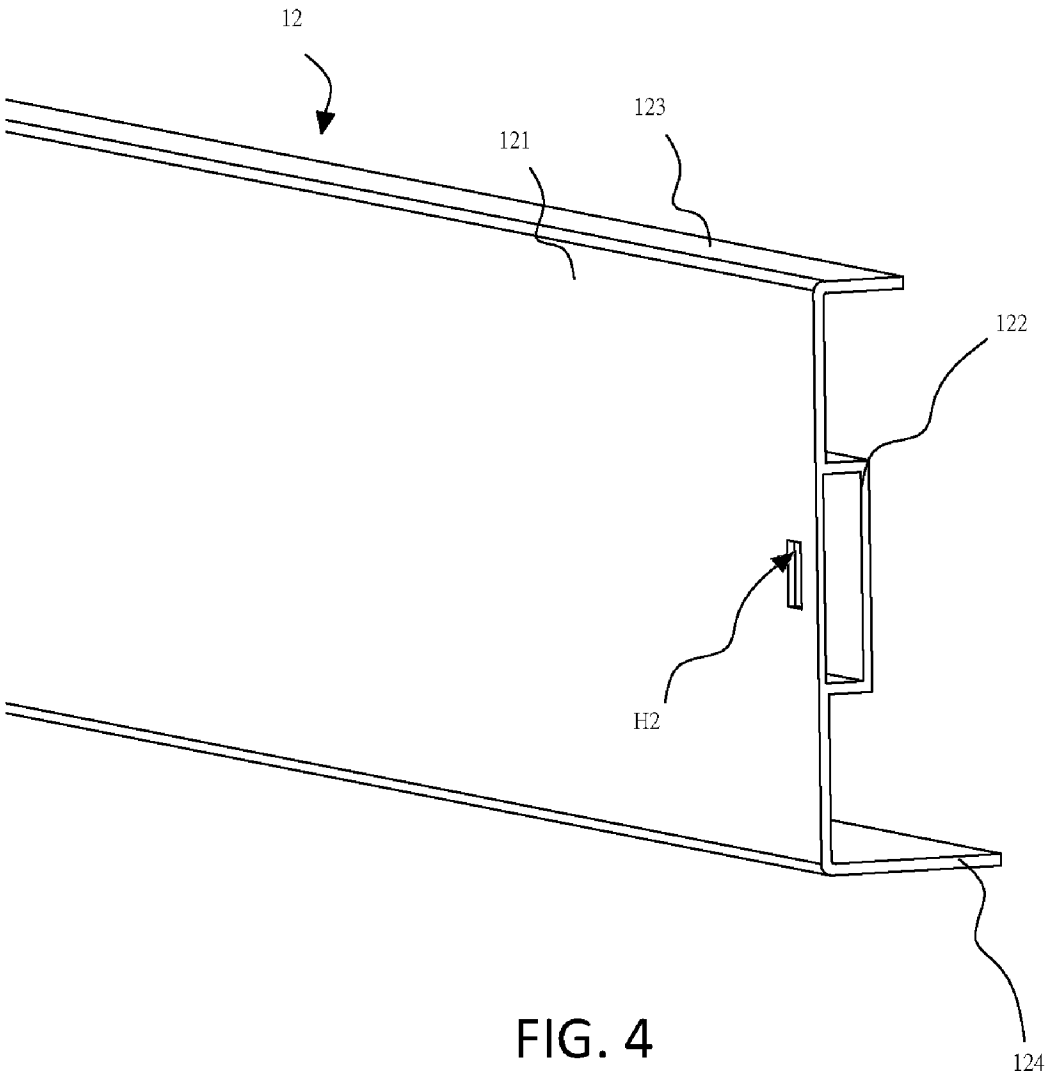
FIG. 4 is a schematic view for illustrating a structure of a second frame bar of the frame structure for ceiling lighting device in accordance with one embodiment of the present invention.

Please refer to FIG. 4, which is a schematic view for illustrating a structure of a second frame bar of the frame structure for ceiling lighting device in accordance with one embodiment of the present invention. As shown in FIG. 4, each second frame bar 12 includes a second frame bar body 121, a second chamber structure 122, a second upper extension plate 123 and a second lower extension plate 124.

The second chamber structure 122 is disposed at one side of the second frame bar body 121. A space is formed between the second chamber structure 122 and the second frame bar body 121. Any one of the two ends of the second chamber structure 122 has an opening. In the embodiment, the space may be rectangular. In another embodiment, the space may also be cylindrical or of other shapes, which can be changed according to actual requirements. The second upper extension plate 123 and second lower extension plate 124 are disposed at the top and bottom of the second frame bar body 121 respectively. Besides, the width of the second upper extension plate 123 is less than that of the second lower extension plate 124. Any one of the two ends of the second frame bar body 121 is provided with a second installation hole H2 connected to the second chamber structure 122.

As set forth above, each first frame bar 11 of the frame structure 1 includes the first frame bar body 111, first upper extension plate 113 and first lower extension plate 114, and the width of the first upper extension plate 113 is greater than that of the first lower extension plate 114. Each second frame bar 12 of the frame structure 1 includes the second frame bar body 121, second upper extension plate 123 and second lower extension plate 124, and the width of the second upper extension plate 123 is less than that of the second lower extension plate 124. Via the above structure design, the first frame bars 11 can be easily fixed on a ceiling (because the width of the first upper extension plate 113 is greater than that of the first lower extension plate 114) and the second frame bars 12 can provide supporting effect (because the width of the second upper extension plate 123 is less than that of the second lower extension plate 124). Moreover, the first frame bars 11 and second frame bars 12 are not interfered with each other. The above structure design can significantly enhance the structural stability of the frame structure 1.

Figure 5:
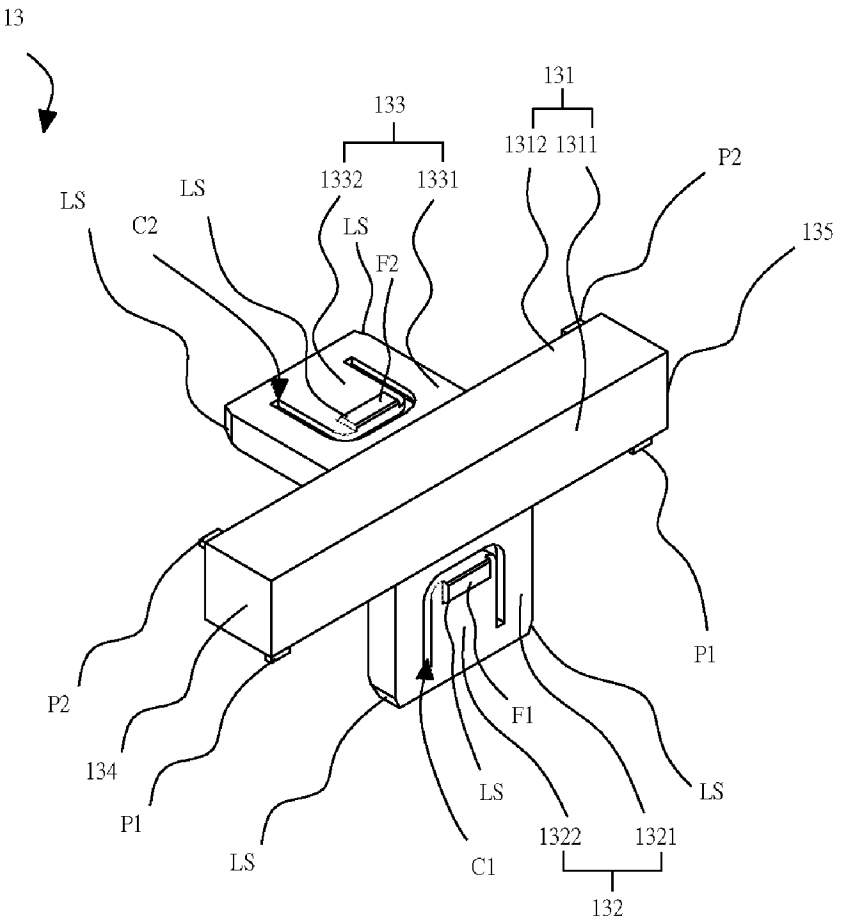
FIG. 5 is a schematic view for illustrating a structure of a corner brace of the frame structure for ceiling lighting device in accordance with one embodiment of the present invention.

Please refer to FIG. 5, which is a schematic view for illustrating a structure of a corner brace of the frame structure for ceiling lighting device in accordance with one embodiment of the present invention. As shown in FIG. 5, each corner brace 13 includes a L-shaped plate 131, a first extension arm 132, a second extension arm 133, an upper cover 134 and a lower cover 135. The upper cover 134 and lower cover 135 are disposed at the top and bottom of the L-shaped plate 131 respectively. The L-shaped plate 131 includes a first portion 1311 and a second portion 1312 perpendicular to each other. The first extension arm 132 and the second extension plate 133 are disposed at the first portion 1311 and second portion 1312 respectively.

The first extension arm 132 includes a first supporting arm 1321 and a first fixation portion 1322 having a first snap-fit hook F1. The first supporting arm 1321 has a first central hole C1. The first fixation portion 1322 is disposed in the first central hole C1 and connected to the first supporting arm 1321. The first snap-fit hook F1 is corresponding to the first installation hole H1 at one of the two ends of the first frame bar body 111. Further, the each of the two corners of the first supporting arm 1321 is provided with a guide slope LS and the first snap-fit hook F1 is also provided with at least one guide slope LS.

Similarly, the second extension arm 133 includes a second supporting arm 1331 and a second fixation portion 1332 having a second snap-fit hook F2. The second supporting arm 1331 has a second central hole C3. The second fixation portion 1332 is disposed in the second central hole C3 and connected to the second supporting arm 1331. The second snap-fit hook F2 is corresponding to the second installation hole H2 at one of the two ends of the second frame bar body 121. Further, the each of the two corners of the second supporting arm 1331 is provided with a guide slope LS and the second snap-fit hook F2 is also provided with at least one guide slope LS.

The embodiment just exemplifies the present invention and is not intended to limit the scope of the present invention; any equivalent modification and variation according to the spirit of the present invention is to be also included within the scope of the following claims and their equivalents.

Figure 6:
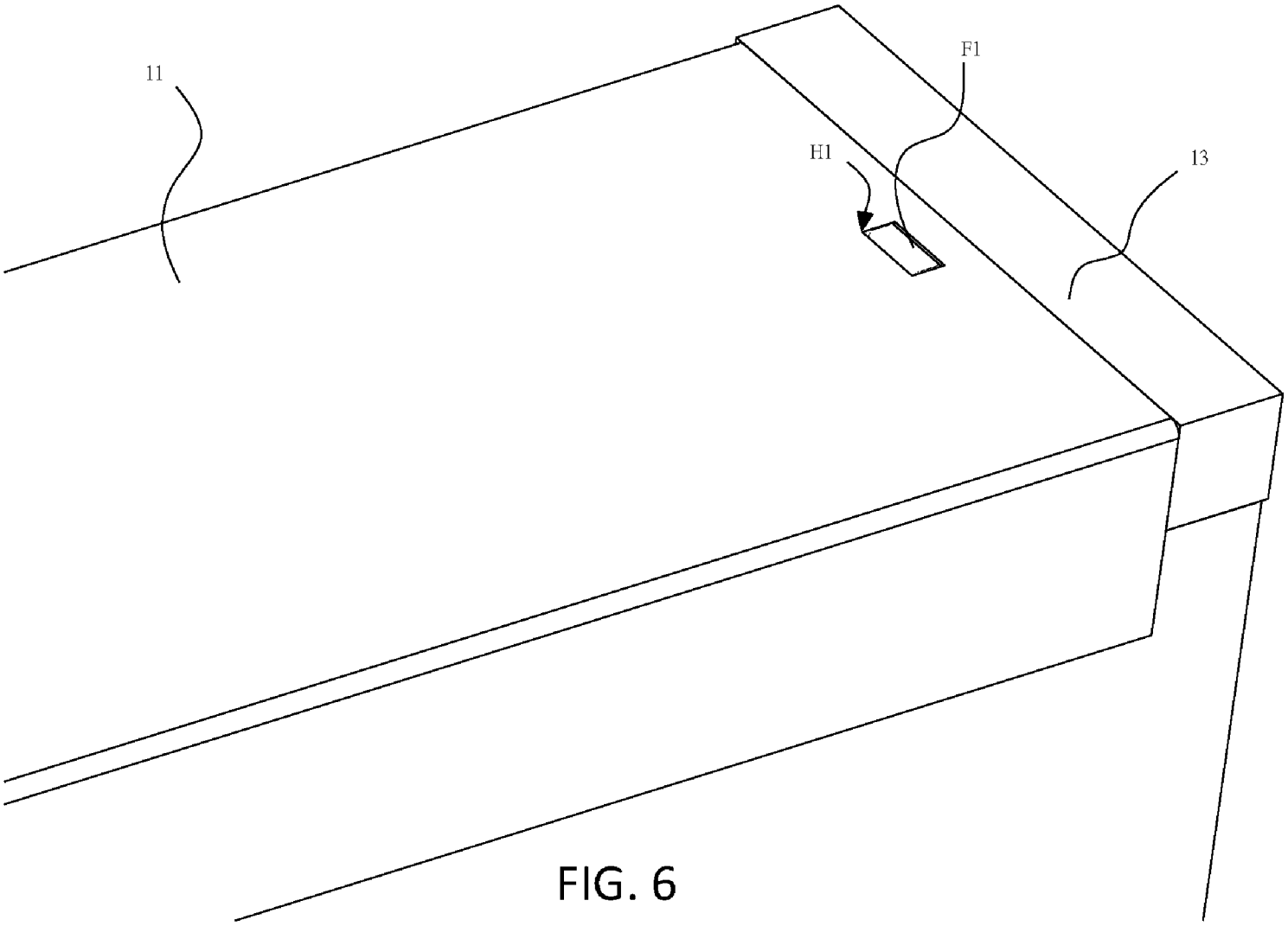
FIG. 6 is a first partial enlargement view of the frame structure for ceiling lighting device in accordance with one embodiment of the present invention.

Please refer to FIG. 6, which is a first partial enlargement view of the frame structure for ceiling lighting device in accordance with one embodiment of the present invention; please also refer to FIG. 5. As shown in FIG. 6, the first extension arm 132 of the corner brace 13 can be inserted into the opening of one end of the first chamber structure 112 of one of the first frame bars 11 in order to enter the space of the first chamber structure 112. Then, the first snap-fit hook F1 of the first fixation portion 1322 can snap into the first installation hole H1 at one end of the first frame bar body 111.

As shown in FIG. 5, there is a distance between the plane passing through the surface of the first portion 1311 of the L-shaped plate 131 and the plane passing through the surface of the first supporting arm 1321 of the first extension arm 132. However, the plane passing through the surface of the first portion 1311 of the L-shaped plate 131 passes through the surface of the first snap-fit hook F1 of the first fixation portion 1322 of the first extension arm 132. In other words, the first supporting arm 1321 is disposed on the inner surface of the first portion 1311 of the L-shaped plate 131.

Similarly, the second extension arm 133 of the corner brace 13 can be inserted into the opening of one end of the second chamber structure 122 of one of the second frame bars 12 in order to enter the space of the second chamber structure 122. Then, the second snap-fit hook F2 of the second fixation portion 1332 can snap into the second installation hole H2 at one end of the second frame bar body 121. There is a distance between the plane passing through the surface of the second portion 1312 of the L-shaped plate 131 and the plane passing through the surface of the second supporting arm 1331 of the second extension arm 133. However, the plane passing through the surface of the second portion 1312 of the L-shaped plate 131 passes through the surface of the second snap-fit hook F2 of the second fixation portion 1332 of the second extension arm 133. In other words, the second supporting arm 1331 is disposed on the inner surface of the second portion 1312 of the L-shaped plate 131.

As shown in FIG. 6, when the first snap-fit hook F1 snaps into the first installation hole H1 at one end of the first frame bar body 111 and the second snap-fit hook F2 snaps into the second installation hole H2 at one end of the second frame bar body 121, the surface of the first snap-fit hook F1 can be parallel to the surface of the first frame bar body 111 and the surface of the second snap-fit hook F2 can be also parallel to the surface of the second frame bar body 121. In this way, the first snap-fit hook F1 does not protrude from the surface of the first frame bar body 111 and the second snap-fit hook F2 also does not protrude from the surface of the second frame bar body 121. Thus, the outer surface of the frame structure 1 can be smooth via the above structure design, so the appearance of the frame structure can be beautiful so as to conform to actual requirements.

Figure 7:
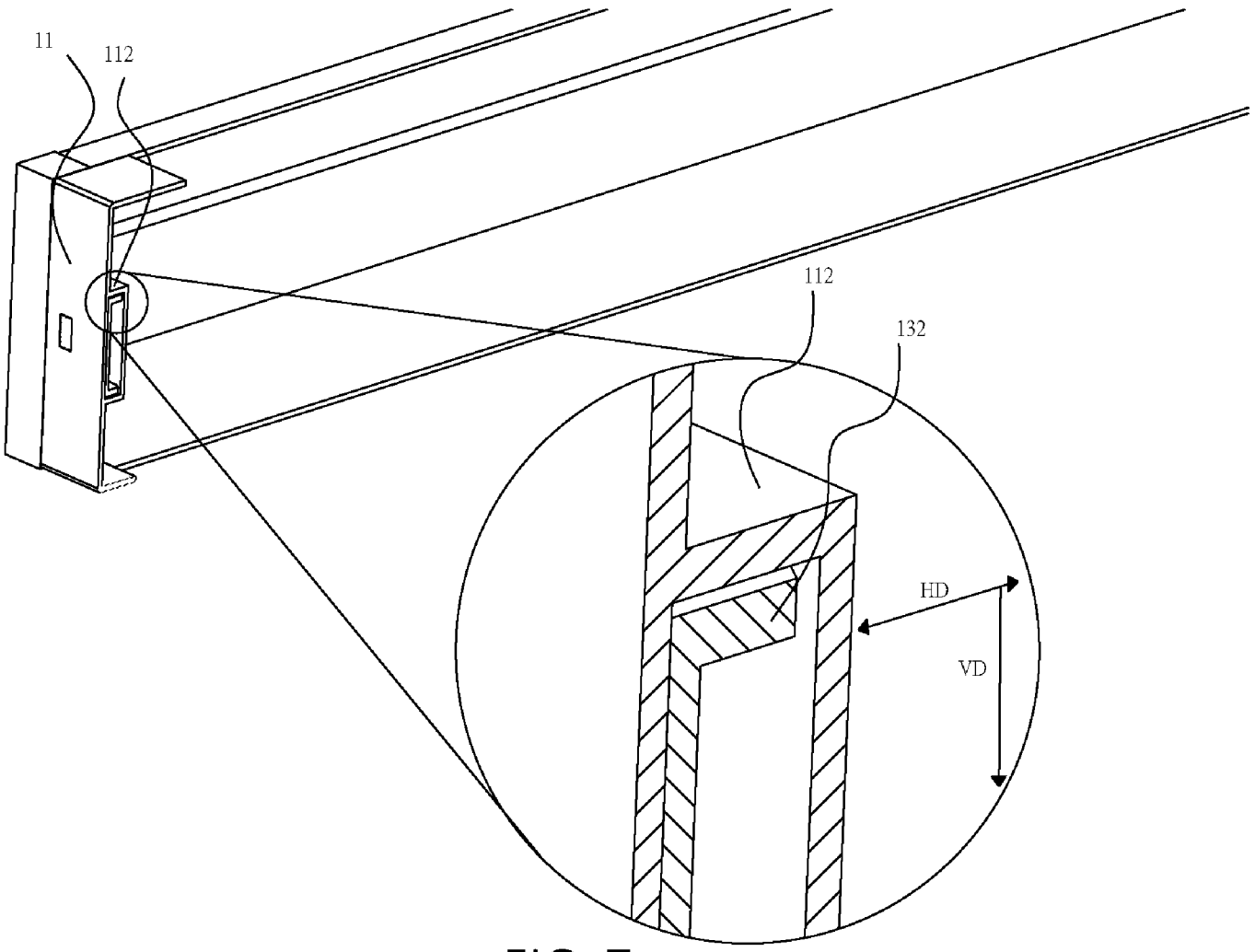
FIG. 7 is a second partial enlargement view of the frame structure for ceiling lighting device in accordance with one embodiment of the present invention.

Please refer to FIG. 7, which is a second partial enlargement view of the frame structure for ceiling lighting device in accordance with one embodiment of the present invention. As previously stated, the first extension arm 132 of the corner brace 13 can be inserted into the opening at one end of the first chamber structure 112 of the first frame bar 11 so as to enter the space of the first chamber structure 112. As shown in FIG. 7, the first extension arm 132 is combined with the first chamber structure 112 via clearance fit in vertical direction VD (the direction parallel to the long side of the first chamber structure 112). On the contrary, the first extension arm 132 is combined with the first chamber structure 112 via interference fit in horizontal direction HD (the direction parallel to the short side of the first chamber structure 112). Via the above composite fixation structure, the first extension arm 132 of the corner brace 13 can be easily inserted into the opening at one end of the first chamber structure 112 of the first frame bar 11. In addition, the corner brace 13 and first frame bar 11 can be stably fixed with each other. All components of the frame structure 1 can be made of plastics (or other flexible materials), so the user can more conveniently assemble the frame structure 1 and the frame structure 1 can still have high structural stability. Further, since all components of the frame structure can be made of plastics, the color of the frame structure 1 can be changed by adding plastic colorant during the manufacturing process thereof. Thus, the frame structure 1 can be more flexible in use.

Figure 8:
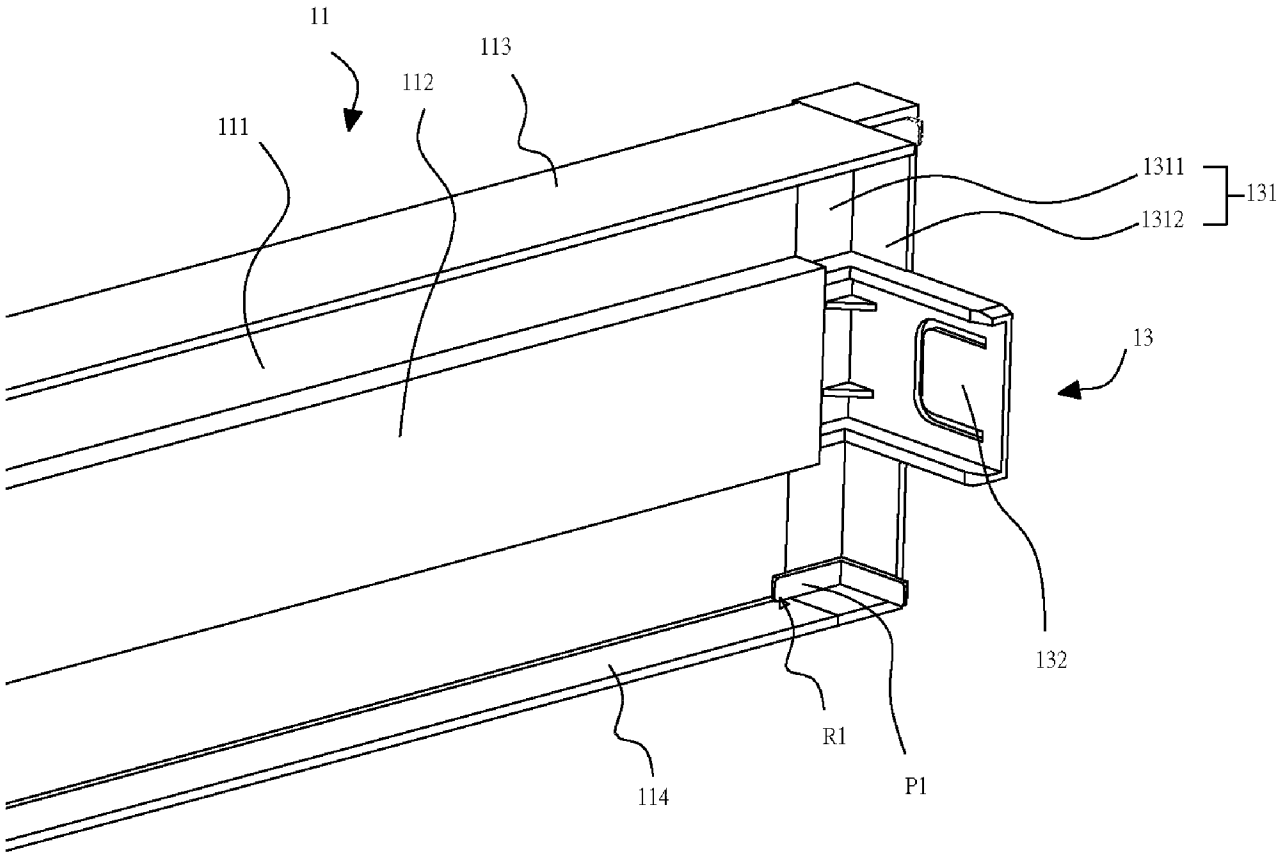
FIG. 8 is a third partial enlargement view of the frame structure for ceiling lighting device in accordance with one embodiment of the present invention.

Please refer to FIG. 8, which is a third partial enlargement view of the frame structure for ceiling lighting device in accordance with one embodiment of the present invention; please also refer to FIG. 5. As shown in FIG. 8, the first portion 1311 of the L-shaped plate 131 of the corner brace 13 includes two first protrusion blocks P1. Any one of the two ends of the first frame bar body 111 of the first frame bar 11 is provided with two first break corners R1. The first protrusion blocks P1 are corresponding to the first break corners R1. In the embodiment, the two first break corners R1 can be disposed on the first frame bar body 111. One of the first break corners R1 can be adjacent to the first upper extension plate 113 and the other of the first break corners R1 can be adjacent to the first lower extension plate 114. When the corner brace 13 is combined with the first frame bar 11, the first protrusion blocks P1 can be inserted into the first break corners R1 respectively. In another embodiment, the positions and numbers of the first protrusion blocks P1 and first break corners R1 can be changed according to actual requirements.

Figure 9:
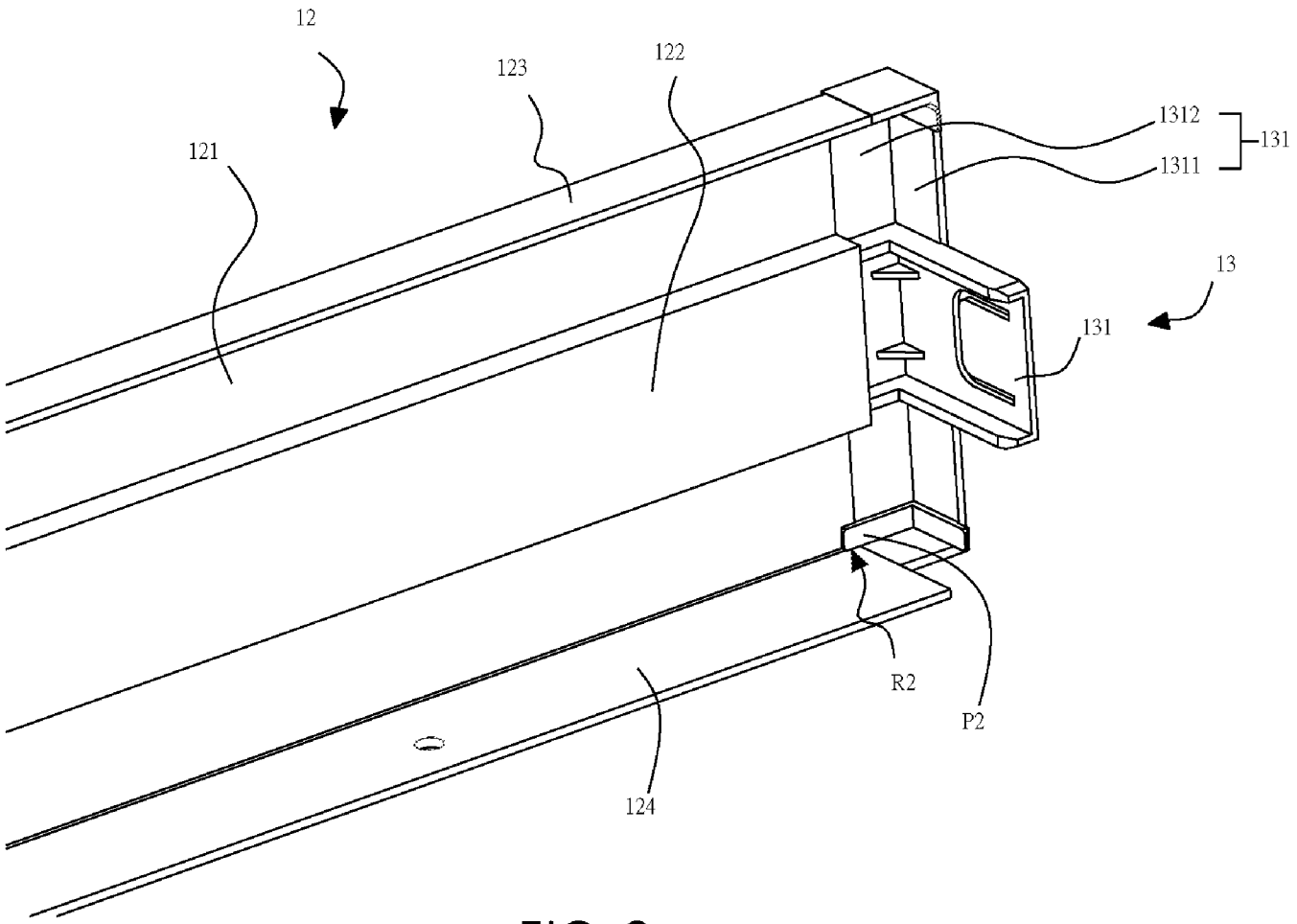
FIG. 9 is a fourth partial enlargement view of the frame structure for ceiling lighting device in accordance with one embodiment of the present invention.

Please refer to FIG. 9, which is a fourth partial enlargement view of the frame structure for ceiling lighting device in accordance with one embodiment of the present invention; please also refer to FIG. 5. As shown in FIG. 9, the second portion 1312 of the L-shaped plate 131 of the corner brace 13 includes two second protrusion blocks P2. Any one of the two ends of the second frame bar body 121 of the second frame bar 12 is provided with two second break corners R2. The second protrusion blocks P2 are corresponding to the second break corners R2. In the embodiment, the two second break corners R2 can be disposed on the second frame bar body 121. One of the second break corners R2 can be adjacent to the second upper extension plate 123 and the other of the second break corners R2 can be adjacent to the second lower extension plate 124. When the corner brace 13 is combined with the second frame bar 12, the second protrusion blocks P2 can be inserted into the second break corners R2 respectively. The structure design of the first protrusion blocks P1, first break corners R1, second protrusion blocks P2 and second break corners R1 can effectively avoid that the frame structure 1 is deformed due to external force with a view to further enhance the structural stability of the frame structure 1. In another embodiment, the positions and numbers of the second protrusion blocks P2 and second break corners R2 can be changed according to actual requirements.

The embodiment just exemplifies the present invention and is not intended to limit the scope of the present invention; any equivalent modification and variation according to the spirit of the present invention is to be also included within the scope of the following claims and their equivalents.

It is worthy to point out that the frame structures of most of currently available ceiling lamps are made of metal, which are heavy in weight and of high cost. Besides, metal components are of high rigidity. Therefore, when several metal components are combined with each other via clearance fit or interference fit, they cannot be stably combined with each other. The above factors make these metal components difficult to be combined with each other. On the contrary, according to one embodiment of the present invention, the frame structure for ceiling lighting device includes the first frame bars, second frame bars and corner braces. The above first frame bars and second frame bars cam be directly combined with each other via the corner braces in order to form the frame structure. Thus, the assembly process of the frame structure can be simple, which is more convenient in use.

According to one embodiment of the present invention, the frame structure for ceiling lighting device includes the first frame bars, second frame bars and corner braces. The first frame bars and second frame bars can be directly combined with each other via the corner braces by interference fit so as to form the frame structure. Therefore, the assembly process of the frame structure can be easily performed and can achieve high structural stability.

Also, according to one embodiment of the present invention, each first frame bar of the frame structure for ceiling lighting device includes the first frame bar body, first upper extension plate and first lower extension plate. Besides, the width of the first upper extension plate is greater than the width of the first lower extension plate. Each second frame bar of the frame structure for ceiling lighting device includes the second frame bar body, second upper extension plate and second lower extension plate. Besides, the width of the second upper extension plate is greater than the width of the second lower extension plate. Via the above structure design, the first frame bars can be easily fixed on the ceiling and the second frame bars can provide supporting effect. In addition, the first frame bars and second frame bars are not interfered with each other. The above structure design can further enhance the structural stability of the frame structure.

Further, according to one embodiment of the present invention, each corner brace of the frame structure for ceiling lighting device includes the L-shaped plate, first extension arm and second extension arm. The L-shaped plate has the first portion and second portion perpendicular to each other. The first extension arm and second extension arm are respectively disposed at the first portion and the second portion. The first extension arm includes the first supporting arm and first fixation portion having the first snap-fit hook. There is a distance between the plane passing through the surface of the first portion and the plane passing through the surface of the first supporting arm. The plane passing through the surface of the first portion passes through the surface of the first snap-fit hook of the first fixation portion. The second extension arm also has the same structure. The above structure design makes the outer surface of the frame structure be smooth, so the appearance of the frame structure can be beautiful so as to conform to actual requirements.

Moreover, according to one embodiment of the present invention, all components of the frame structure for ceiling lighting device can be made of plastics duo to the structure design thereof. Accordingly, the weight of the frame structure can be greatly reduced and the cost thereof can be effectively decreased. Thus, the application of the frame structure can be more comprehensive in application.

Furthermore, according to one embodiment of the present invention, all components of the frame structure for ceiling lighting device can be made of plastics duo to the structure design thereof. Therefore, the color of the frame structure can be changed by adding plastic colorant during the manufacturing process thereof. Thus, the frame structure can be more flexible in use. As described above, the frame structure for ceiling lighting device according to the embodiments of the present invention can definitely achieve great technical effects.

Figure 10A:
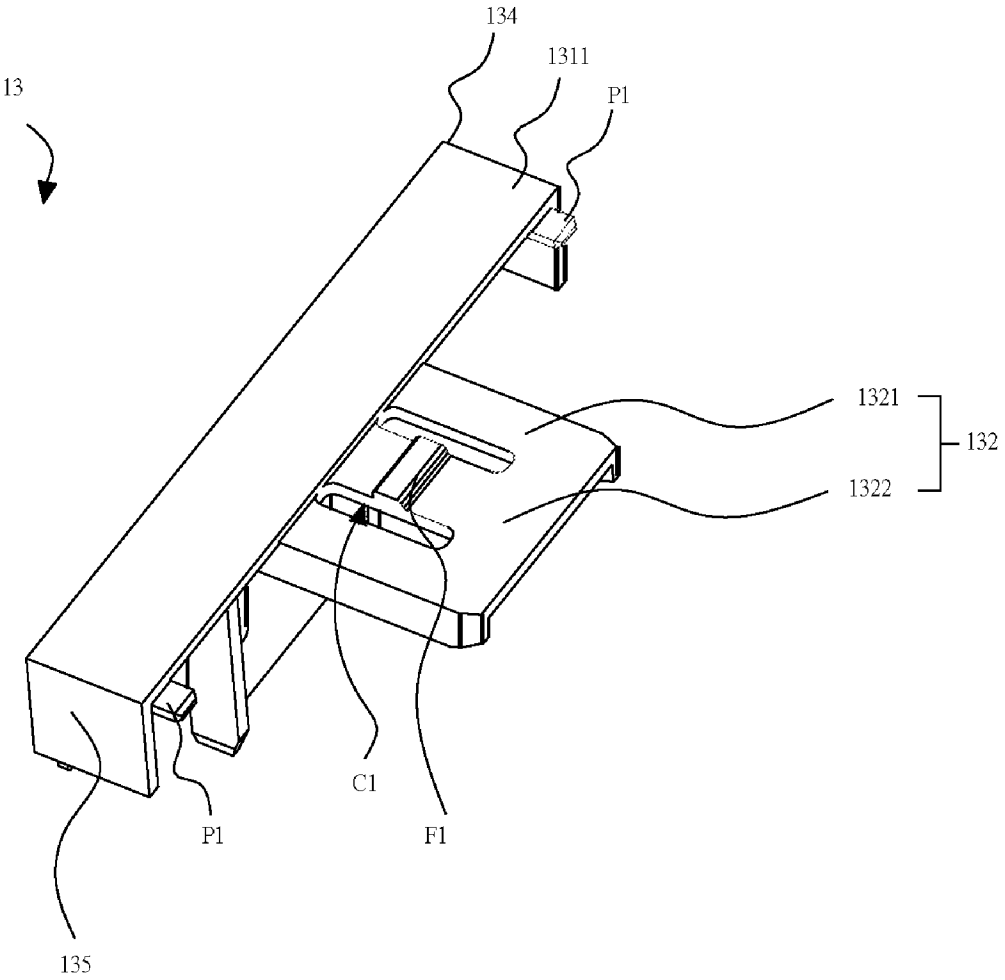
FIG. 10A is a schematic view for illustrating a structure of a corner brace of the frame structure for ceiling lighting device in accordance with another embodiment of the present invention.
Figure 10B:
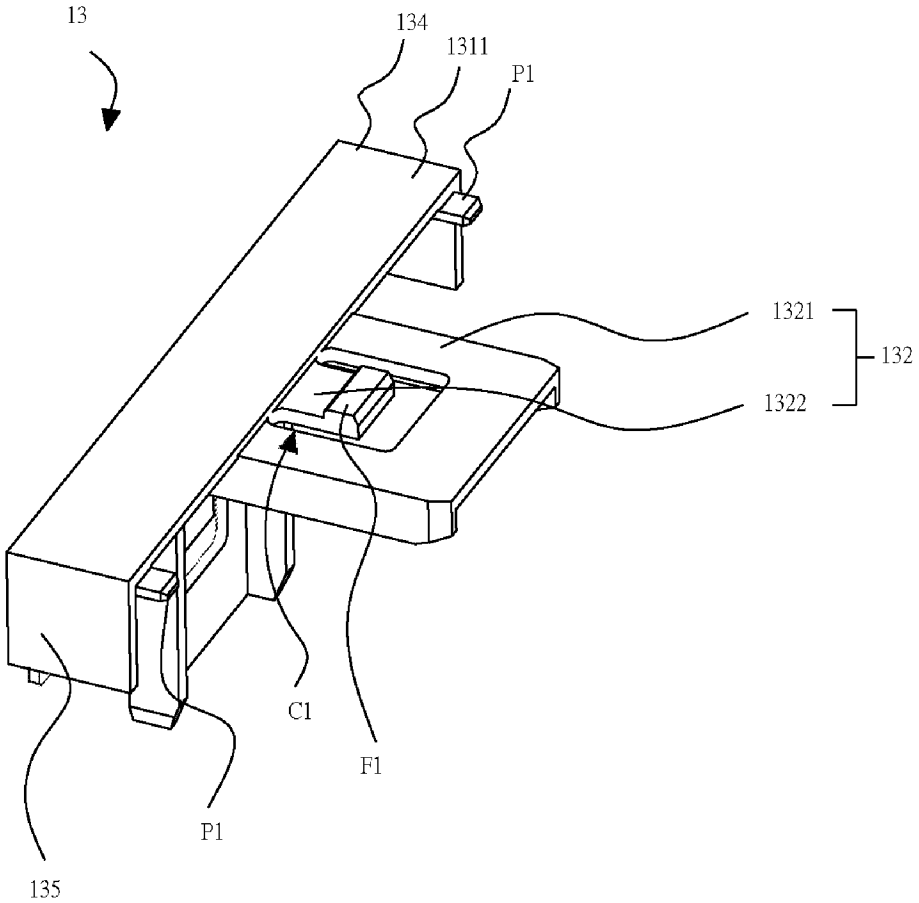
FIG. 10B is a schematic view for illustrating a structure of a corner brace of the frame structure for ceiling lighting device in accordance with still another embodiment of the present invention.
Figure 10C:
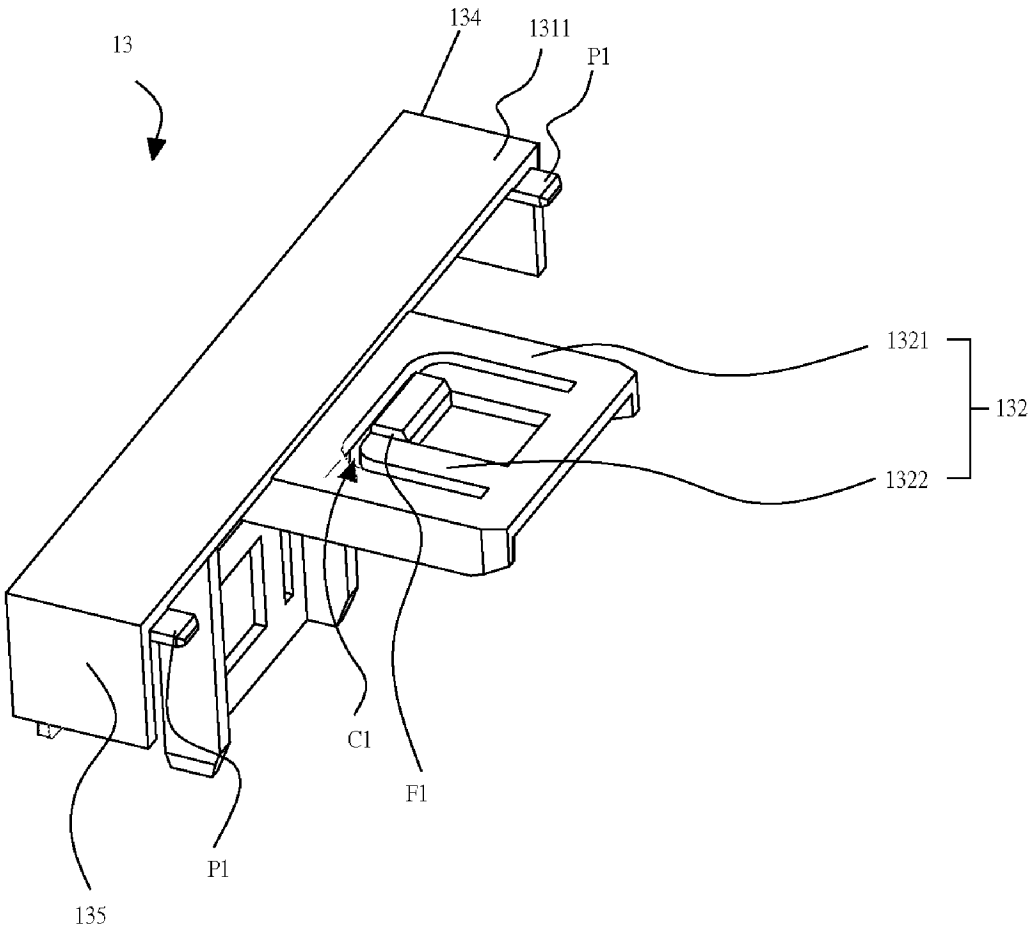
FIG. 10C is a schematic view for illustrating a structure of a corner brace of the frame structure for ceiling lighting device in accordance with still another embodiment of the present invention.

Please refer to FIG. 10A, FIG. 10B and FIG. 10C. FIG. 10A is a schematic view for illustrating a structure of a corner brace of the frame structure for ceiling lighting device in accordance with another embodiment of the present invention. FIG. 10B is a schematic view for illustrating a structure of a corner brace of the frame structure for ceiling lighting device in accordance with still another embodiment of the present invention. FIG. 10C is a schematic view for illustrating a structure of a corner brace of the frame structure for ceiling lighting device in accordance with still another embodiment of the present invention. As shown in FIG. 10A, the first extension arm 132 of the corner brace 13 includes a first supporting arm 1321 and a first fixation portion 1322 having a first snap-fit hook F1. The first supporting arm 1321 has a first central hole C1 and the first fixation portion 1322 is disposed in the first central hole C1. In addition, the first fixation portion 1322 is connected to the first portion 1311 of the L-shaped plate 131 and first supporting arm 1321. The second extension arm 133 of the corner brace 13 also has the same structure.

As shown in FIG. 10B, the first extension arm 132 of the corner brace 13 includes a first supporting arm 1321 and a first fixation portion 1322 having a first snap-fit hook F1. The first supporting arm 1321 has a first central hole C1 and the first fixation portion 1322 is disposed in the first central hole C1. In addition, the first fixation portion 1322 is connected to the first portion 1311 of the L-shaped plate 131. The second extension arm 133 of the corner brace 13 also has the same structure.

As shown in FIG. 10C, the first extension arm 132 of the corner brace 13 includes a first supporting arm 1321 and a first fixation portion 1322 having a first snap-fit hook F1. The first fixation portion 1322 is U-shaped. The first supporting arm 1321 has a first central hole C1 and the first fixation portion 1322 is disposed in the first central hole C1. In addition, the first fixation portion 1322 is connected to the first supporting arm 1321. The second extension arm 133 of the corner brace 13 also has the same structure. In the above embodiments, the corner brace 13 and the first snap-fit hooks F1 can be integrally formed.

Figure 11:
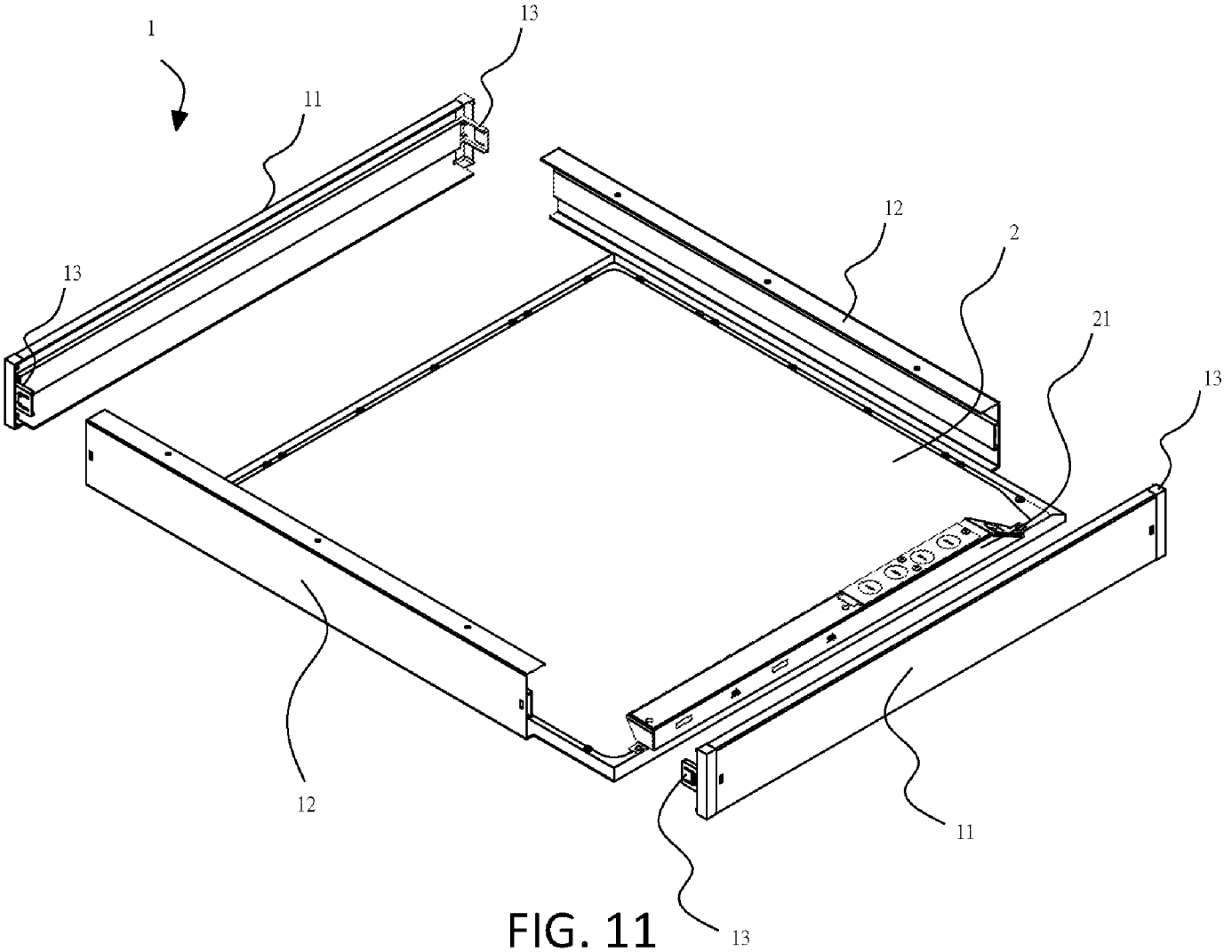
FIG. 11 is a first schematic view for illustrating a combination of the frame structure for ceiling lighting device and a light source board in accordance with still another embodiment of the present invention.
Figure 12:
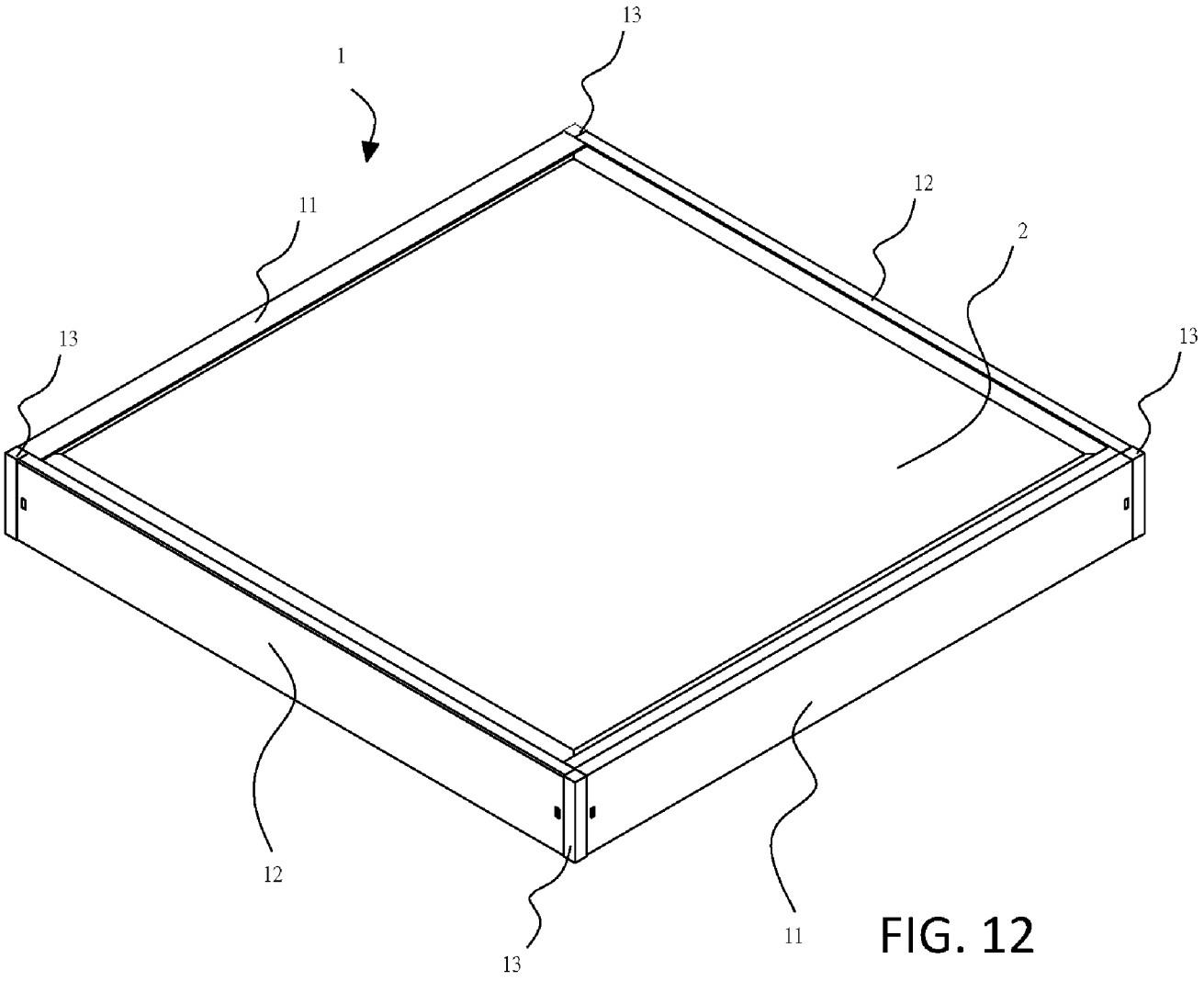
FIG. 12 is a second schematic view for illustrating the combination of the frame structure for ceiling lighting device and the light source board in accordance with still another embodiment of the present invention.

Please refer to FIG. 11 and FIG. 12, which are a first schematic view and a second schematic view for illustrating a combination of the frame structure for ceiling lighting device and a light source board in accordance with still another embodiment of the present invention respectively. As shown in FIG. 11 and FIG. 12, the first frame bars 11 and the second frame bars 12 can be combined with each other via the corner braces 13 to form the frame structure 1. The light source board 2 having a power supply module 21 can be disposed in the frame structure 1, which can serve as a ceiling lighting device in order to provide lighting function.

The embodiment just exemplifies the present invention and is not intended to limit the scope of the present invention; any equivalent modification and variation according to the spirit of the present invention is to be also included within the scope of the following claims and their equivalents.

To sum up, according to one embodiment of the present invention, the frame structure for ceiling lighting device includes the first frame bars, second frame bars and corner braces. The above first frame bars and second frame bars cam be directly combined with each other via the corner braces in order to form the frame structure. Thus, the assembly process of the frame structure can be simple, which is more convenient in use.

According to one embodiment of the present invention, the frame structure for ceiling lighting device includes the first frame bars, second frame bars and corner braces. The first frame bars and second frame bars can be directly combined with each other via the corner braces by interference fit so as to form the frame structure. Therefore, the assembly process of the frame structure can be easily performed and can achieve high structural stability.

Also, according to one embodiment of the present invention, each first frame bar of the frame structure for ceiling lighting device includes the first frame bar body, first upper extension plate and first lower extension plate. Besides, the width of the first upper extension plate is greater than the width of the first lower extension plate. Each second frame bar of the frame structure for ceiling lighting device includes the second frame bar body, second upper extension plate and second lower extension plate. Besides, the width of the second upper extension plate is greater than the width of the second lower extension plate. Via the above structure design, the first frame bars can be easily fixed on the ceiling and the second frame bars can provide supporting effect. In addition, the first frame bars and second frame bars are not interfered with each other. The above structure design can further enhance the structural stability of the frame structure.

Further, according to one embodiment of the present invention, each corner brace of the frame structure for ceiling lighting device includes the L-shaped plate, first extension arm and second extension arm. The L-shaped plate has the first portion and second portion perpendicular to each other. The first extension arm and second extension arm are respectively disposed at the first portion and the second portion. The first extension arm includes the first supporting arm and first fixation portion having the first snap-fit hook. There is a distance between the plane passing through the surface of the first portion and the plane passing through the surface of the first supporting arm. The plane passing through the surface of the first portion passes through the surface of the first snap-fit hook of the first fixation portion. The second extension arm also has the same structure. The above structure design makes the outer surface of the frame structure be smooth, so the appearance of the frame structure can be beautiful so as to conform to actual requirements.

Moreover, according to one embodiment of the present invention, all components of the frame structure for ceiling lighting device can be made of plastics duo to the structure design thereof. Accordingly, the weight of the frame structure can be greatly reduced and the cost thereof can be effectively decreased. Thus, the application of the frame structure can be more comprehensive in application.

Furthermore, according to one embodiment of the present invention, all components of the frame structure for ceiling lighting device can be made of plastics duo to the structure design thereof. Therefore, the color of the frame structure can be changed by adding plastic colorant during the manufacturing process thereof. Thus, the frame structure can be more flexible in use.

It will be apparent to those skilled in the art that various modifications and variations can be made to the disclosed embodiments. It is intended that the specification and examples be considered as exemplary only, with a true scope of the present invention being indicated by the following claims and their equivalents.

What is claimed is:

1. A frame structure for ceiling lighting device, comprising:

a plurality of first frame bars, wherein each of the first frame bars comprises a first frame bar body and a first chamber structure disposed on one side of the first frame bar body;

a plurality of second frame bars, wherein each of the second frame bars comprises a second frame bar body and a second chamber structure disposed on one side of the second frame bar body; and a plurality of corner braces, wherein each of the corner braces comprises a first extension arm inserted into an opening at one end of the first chamber structure of one of the first frame bars and a second extension arm inserted into an opening at one end of the second chamber structure of one of the second frame bars, whereby the first frame bars and the second frame bars are combined with each other;

wherein each of the corner braces further comprises a L-shaped plate, an upper cover and a lower cover, wherein the upper cover and the lower cover are respectively disposed at a top and a bottom of the L-shaped plate, wherein the L-shaped plate comprises a first portion and a second portion perpendicular to each other, and the first extension arm and the second extension arm are respectively disposed at the first portion and the second portion, wherein the first extension arm comprises a first supporting arm having a first central hole and a first fixation portion having a first snap-fit hook, wherein the first fixation portion is disposed in the first central hole and connected to the first supporting arm, wherein any one of two ends of the first frame bar body of each of the first frame bars is provided with a first installation hole and the first snap-fit hook is corresponding one of the first installation holes, wherein the first frame bars, the second frame bars and the corner braces are made of plastics.

2. The frame structure for ceiling lighting device as claimed in claim 1, wherein the first extension arm is combined with the first chamber structure in a vertical direction via clearance fit, and the first extension arm is combined with the first chamber structure in a horizontal direction via interference fit.

3. The frame structure for ceiling lighting device as claimed in claim 1, wherein each of the first frame bars further comprises a first upper extension plate and a first lower extension plate respectively disposed at a top and a bottom of the first frame bar body of the first frame bar, wherein a width of the first upper extension plate is greater than a width of the first lower extension plate.

4. The frame structure for ceiling lighting device as claimed in claim 1, wherein each of the second frame bars further comprises a second upper extension plate and a second lower extension plate respectively disposed at a top and a bottom of the second frame bar body of the second frame bar, wherein a width of the second upper extension plate is less than a width of the second lower extension plate.

5. The frame structure for ceiling lighting device as claimed in claim 1, wherein each of the first portions comprises a first protrusion block and any one of two ends of the first frame bar body of each of the first frame bars is provided with a first break corner, wherein the first protrusion block is corresponding to one of the first break corners.

6. The frame structure for ceiling lighting device as claimed in claim 1, wherein each of the second portions comprises a second protrusion block and any one of two ends of the second frame bar body of each of the second frame bars is provided with a second break corner, wherein the second protrusion block is corresponding to one of the second break corners.

7. The frame structure for ceiling lighting device as claimed in claim 1, wherein there is a distance between a plane passing through a surface of the first portion and a plane passing through a surface of the first supporting arm, and the plane passing through the surface of the first portion passes through a surface of the first snap-fit hook of the first fixation portion.

8. The frame structure for ceiling lighting device as claimed in claim 1, wherein the second extension arm comprises a second supporting arm having a second central hole and a second fixation portion having a second snap-fit hook, wherein the second fixation portion is disposed in the second central hole and connected to the second supporting arm, wherein any one of two ends of the second frame bar body of each of the f second frame bars is provided with a second installation hole and the second snap-fit hook is corresponding one of the second installation holes, wherein there is a distance between a plane passing through a surface of the second portion and a plane passing through a surface of the second supporting arm, and the plane passing through the surface of the second portion passes through a surface of the second snap-fit hook of the second fixation portion.

* * * * *